United States Patent [19]

Kim

[11] Patent Number: 4,951,780

[45] Date of Patent: Aug. 28, 1990

[54] COMBINATION LADDER AND HEIGHT ADJUSTABLE SCAFFOLD

[76] Inventor: Myung H. Kim, 34 Rhodes St., New Hyde Park, N.Y. 11040

[21] Appl. No.: 229,628

[22] Filed: Aug. 8, 1988

[51] Int. Cl.[5] ..... E06C 1/39; E06C 7/16; E06C 7/50

[52] U.S. Cl. ..... 182/27; 182/167; 182/119

[58] Field of Search ..... 182/165, 166, 167, 119, 182/27, 163

[56] References Cited

U.S. PATENT DOCUMENTS

| | | | |
|---|---|---|---|
| 391,182 | 10/1888 | Nosker | 182/119 |
| 506,561 | 10/1893 | Smith | 182/119 |
| 2,024,039 | 12/1935 | Harting | 182/119 |
| 2,162,040 | 6/1939 | Webster | 182/119 |
| 2,186,484 | 1/1940 | Gunther | 182/119 |
| 2,619,390 | 11/1952 | Johnson | 182/119 |
| 3,692,143 | 9/1972 | Kummerlin et al. | |
| 3,794,141 | 2/1974 | Sturm | |
| 3,811,151 | 5/1974 | Kummerlin | |
| 4,152,810 | 5/1979 | Martinez | |
| 4,210,224 | 7/1980 | Kummerlin et al. | |
| 4,216,844 | 8/1980 | Klafs | |
| 4,371,055 | 2/1983 | Ashton | 182/104 |
| 4,376,470 | 3/1983 | Ashton | |
| 4,377,020 | 3/1983 | Vigo | |
| 4,403,373 | 8/1983 | Kummerlin | |
| 4,407,045 | 10/1983 | Boothe | |
| 4,543,007 | 8/1985 | Quiogue | |
| 4,566,150 | 1/1986 | Boothe | |
| 4,645,371 | 2/1987 | Wang | |
| 4,666,328 | 5/1987 | Ryu | |

FOREIGN PATENT DOCUMENTS

| | | | |
|---|---|---|---|
| 424275 | 1/1926 | Fed. Rep. of Germany | 182/119 |
| 854996 | 11/1952 | Fed. Rep. of Germany | 182/119 |
| 2228045 | 12/1973 | Fed. Rep. of Germany | 182/167 |
| 1137078 | 1/1957 | France | 182/27 |

*Primary Examiner*—Reinaldo P. Machado
*Attorney, Agent, or Firm*—Klauber & Jackson

[57] ABSTRACT

A combination folding ladder and height adjustable scaffold, comprises (a) a first assembly including a first leg and a second leg, each formed by an outer and inner telescoping member, and outer and inner rungs which connect the outer and inner telescoping members in substantially parallel, spaced apart relation; (b) a second assembly including a third leg and a fourth leg, each formed by an outer and inner telescoping member, and outer and inner rungs which connect the outer and inner telescoping legs of the third and fourth legs in substantially parallel, spaced apart relation; (c) positioning joints removably secured to upper ends of the for pivotally securing the first and second assemblies together; (d) a height adjustment assembly for varying the heights of the legs; and (e) a scaffold platform for use with the combination when the positioning joints are removed from the legs and the first and second assemblies are separated, the scaffold platform including a flat rectangular board, U-shaped supports at the opposite short ends for defining channels for receiving any of the rungs at a first vertical level, and a plurality of hook arms pivotally secured to the underside of the board and having hook ends for receiving any of the rungs at a second vertical level, such that a stable scaffold is provided by the first assembly, the second assembly separated therefrom and the scaffold platform connecting together the first and second assemblies.

23 Claims, 9 Drawing Sheets

COMBINATION LADDER AND HEIGHT ADJUSTABLE SCAFFOLD

BACKGROUND OF THE INVENTION

This invention relates generally to folding ladders and, more particularly, is directed to a combination ladder and height adjustable scaffold.

The use of extensible folding ladders is well known in the art, and is taught, for example in U.S. Pat. Nos. 3,692,143 to Kummerlin et al; 3,794,141 to Sturm; 4,210,224 to Kummerlin et al; 4,371,055 to Ashton; and 4,376,470 to Ashton. Such ladders generally have positioning joints at the upper ends thereof for permitting movement of the ladder between different angular positions, and releasably fixing the ladder at such selected angular positions. Such positioning joints are rigidly secured to the legs or stringers of the ladder by means of rivets or screws, and are not intended to and cannot be removed therefrom. In other words, such positioning joints form an integral part of the ladder. Such positioning joints are well known and are taught, for example, in U.S. Pat. Nos. 3,811,151 to Kuemmerlin; 4,152,810 to Martinez; 4,216,844 to Klafs; 4,377,020 to Vigo; 4,403,373 to Kummerlin; 4,407,045 to Boothe; 4,543,007 to Quiogue; 4,566,150 to Boothe; 4,645,371 to Wang; and 4,666,328 to Ryu.

In order to use such ladders in a scaffold configuration, two ladders must be provided, each for supporting one end of a board. In such case, the board merely rests on the rungs of the two ladders, and is therefore subject to slipping therefrom. Accordingly, such arrangements are not very safe. In addition, because two ladders are required, the cost is very much increased, and it is less expensive to construct a conventional scaffold without the use of ladders. However, a conventional scaffold is not very flexible. Accordingly, when it is desired to increase the height of such conventional scaffold, another layer must be added, thereby increasing the cost still further.

OBJECTS AND SUMMARY OF THE INVENTION

Accordingly, it is an object of the present invention to provide a combination extensible folding ladder and height adjustable scaffold that overcomes the aforementioned problems encountered in the prior art.

It is another object of the present invention to provide such a combination in which the folding ladder can be disassembled and used as a scaffold.

It is still another object of the present invention to provide height adjustability of such a combination when used as either a folding ladder or scaffold.

It is yet another object of the present invention to provide such a combination that is relatively easy and economical to manufacture and operate.

In accordance with an aspect of the present invention, a combination folding ladder and height adjustable scaffold, comprises:

(a) a first assembly including a first leg, a second leg, and a plurality of rungs connecting together the first and second legs in substantially parallel, spaced apart relation, each rung adapted to support one end of a scaffold platform;

(b) a second assembly including a third leg, a fourth leg, and means for connecting together the third and fourth legs in substantially parallel, spaced apart relation and for providing a scaffold support which supports an opposite end of the scaffold platform;

(c) joint means removably secured to upper ends of the first through fourth legs for pivotally securing the first and second assemblies together; and (d) securing means for removably securing the joint means to upper ends of the first through fourth legs.

In accordance with another aspect of the present invention, a combination folding ladder and height adjustable scaffold, comprises:

(a) a first assembly including a first leg, a second leg, and a plurality of rungs connecting together the first and second legs in substantially parallel, spaced apart relation;

(b) a second assembly including a third leg, a fourth leg, and means for connecting together the third and fourth legs in substantially parallel, spaced apart relation and for providing a scaffold support;

(c) joint means removably secured to upper ends of the first through fourth legs for pivotally securing the first and second assemblies together;

(d) securing means for removably securing the joint means to upper ends of the first through fourth legs; and (e) a scaffold platform for use with the combination folding ladder and height adjustable scaffold when the joint means is removed from the upper ends of the first through fourth legs and the first and second assemblies are separated, the scaffold platform including first means at one end of the platform for supporting the one end on at least one rung of the first assembly, and second means at the opposite end of the platform for supporting the opposite end on the means for connecting of the second assembly, so as to provide a stable scaffold with the first assembly, the second assembly separated therefrom and the scaffold platform connecting together the first and second assemblies.

In accordance with still another aspect of the present invention, a combination folding ladder and height adjustable scaffold, includes:

(a) a first assembly including a first leg having an outer telescoping member and an inner telescoping member which telescopically slides therein, a second leg having an outer telescoping member and an inner telescoping member which telescopically slides therein, a plurality of inner rungs connecting together the inner telescoping members of the first and second legs in substantially parallel, spaced apart relation, and a plurality of outer rungs connecting together the outer telescoping members of the first and second legs in substantially parallel, spaced apart relation;

(b) a second assembly including a third leg having an outer telescoping member and an inner telescoping member which telescopically slides therein, a fourth leg having an outer telescoping member and an inner telescoping member which telescopically slides therein, a plurality of inner rungs connecting together the inner telescoping members of the third and fourth legs in substantially parallel, spaced apart relation, and a plurality of outer rungs connecting together the outer telescoping members of the third and fourth legs in substantially parallel, spaced apart relation;

(c) joint means removably secured to upper ends of the first through fourth legs for pivotally securing the first and second assemblies together;

(d) securing means for removably securing the joint means to upper ends of the first through fourth legs;

(e) height adjustment means for releasably locking the inner telescoping members of the first through fourth legs at any of a plurality of selected heights with respect to the outer telescoping members of the first through fourth legs; and (f) a scaffold platform for use with the combination folding ladder and height adjustable scaffold when the joint means is removed from the upper ends of the first through fourth legs and the first and second assemblies are separated, the scaffold platform including a substantially flat rectangular board having short ends and long ends, U-shaped support means at the opposite short ends of the flat board on the underside thereof for defining channel means for receiving any of the rungs of the first and second assemblies at a first vertical level so as to support opposite ends of the board, and a plurality of hook arms pivotally secured to the underside of the board for receiving any of the rungs of the first and second assemblies at a second vertical level so as to support opposite ends of the board, each hook arm having a hook end for receiving and engaging any of the rungs of the first and second assemblies, wherein a stable scaffold is provided by the first assembly, the second assembly separated therefrom and the scaffold platform connecting together the first and second assemblies.

The above and other objects, features and advantages of the present invention will become readily apparent from the following detailed description which is to be read in connection with the accompanying drawings.

DETAILED DESCRIPTION OF THE PREFERRED EMBODIMENTS

Figure 1:
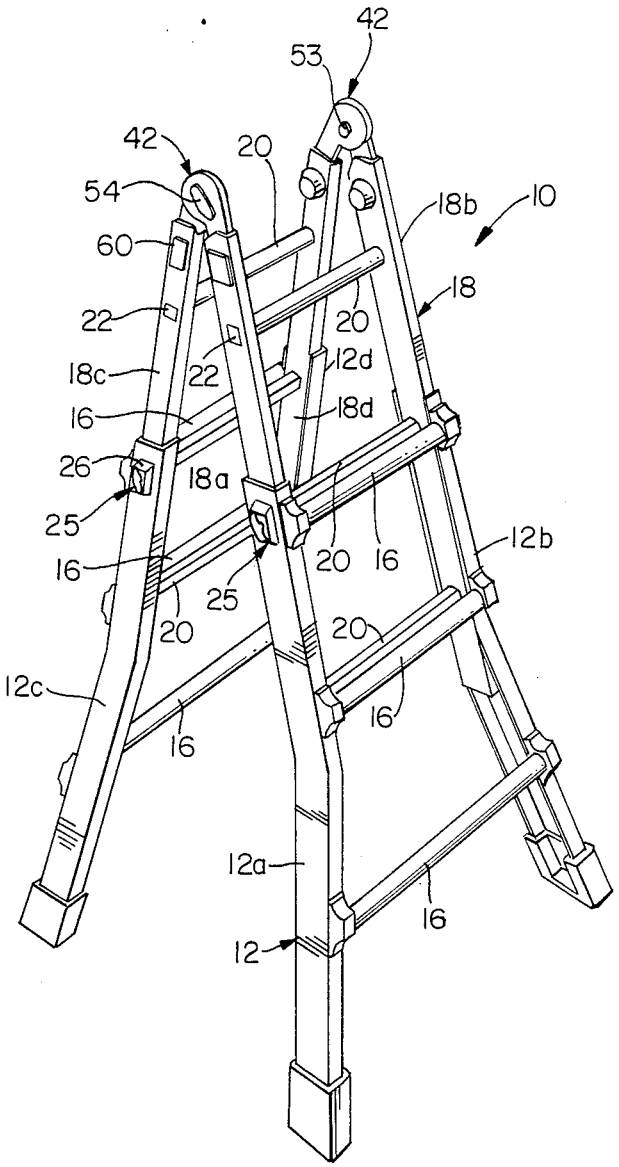
FIG. 1 is a perspective view of a combination folding ladder and height adjustable scaffold according to one embodiment of the present invention.

Referring to the drawings in detail, a combination extensible folding ladder and height adjustable scaffold 10 according to the present invention is shown in FIG. 1 in its ladder configuration. As shown, combination folding ladder and height adjustable scaffold 10 includes four outer telescoping legs 12, designated by **12*a*, 12*b*, 12*c* and 12*d*, each outer telescoping leg 12 having a substantially U-shaped configuration with side leg sections 13*a* and 13*b* and a connecting leg section 13*c*, and thereby defining a longitudinal channel 14 (FIG. 4) extending therein. Outer telescoping legs 12 are arranged in pairs 12*a*, 12*b* and 12*c*, 12*d*, such that the open channels 14 of legs 12*a*, 12*b* and 12*c*, 12*d* in each pair face each other. Each outer telescoping leg 12*a* and 12*c* of each pair is connected to the other outer telescoping leg 12*b* and 12*d*, respectively, of the respective pair by outer rungs 16 secured to external surfaces of the U-shaped outer telescoping legs 12**.

Combination folding ladder and height adjustable scaffold 10 further includes four inner telescoping legs 18, designated by **18*a*, 18*b*, 18*c* and 18*d*, that slidably fit within channels 14 of outer telescoping legs 12*a*, 12*b*, 12*c* and 12*d*, respectively, for adjusting the height of combination folding ladder and height adjustable scaffold 10 when in the ladder or scaffold configuration. Inner telescoping legs 18 are likewise arranged in pairs 18*a*, 18*b* and 18*c*, 18*d*, with the inner telescoping leg 18*a* and 18*c* of each pair being connected to the other inner telescoping leg 18*b* and 18*d*, of the respective pair by inner rungs 20 secured to the facing surfaces of inner telescoping legs 18. In this manner, the pair of inner telescoping legs 18*a*, 18*b* slide within the pair of outer telescoping legs 12*a*, 12*b*, and during such sliding movement, inner rungs 20 slide adjacent to outer rungs 16** without interference therefrom.

The aforementioned arrangement is conventional, and is of the type described in U.S. Pat. No. 3,692,143 to Kummerlin et al, U.S. Pat. No. 4,371,055 to Ashton et al, and U.S. Pat. No. 4,376,470 to Ashton, the entire disclosures of which are incorporated herein by reference.

Figure 4:
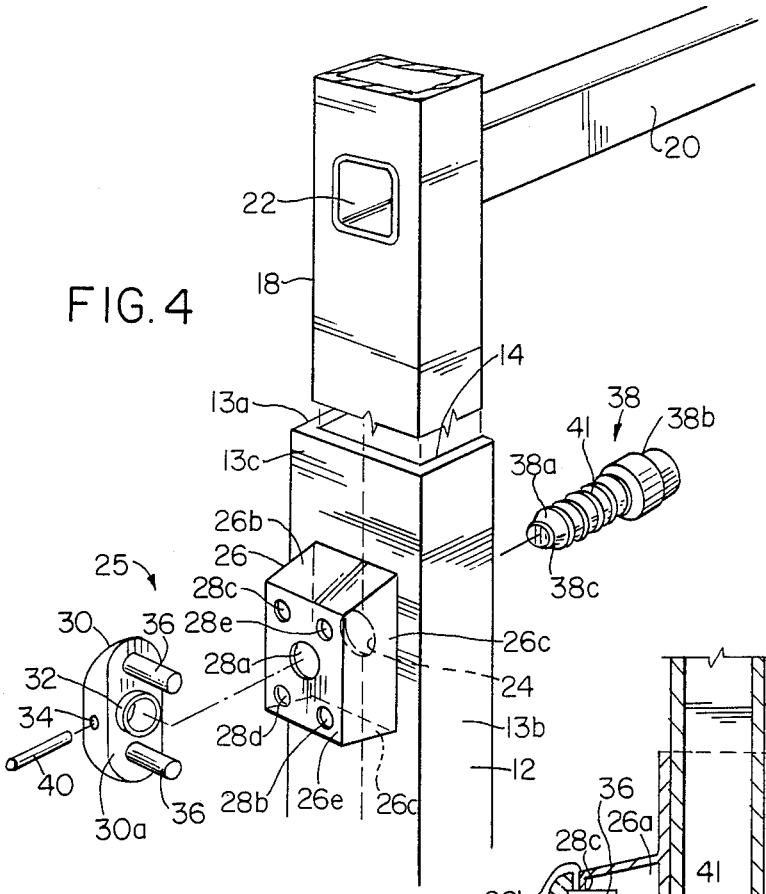
FIG. 4 is an exploded perspective view of one height adjustment assembly of the combination folding ladder and height adjustable scaffold of FIG. 1.
Figure 5:
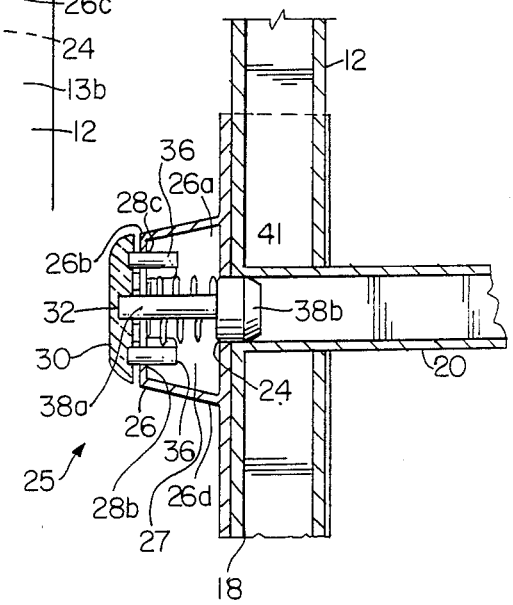
FIG. 5 is a cross-sectional view of the height adjustment assembly of FIG. 4 in assembled condition.

As shown best in FIGS. 4 and 5, inner telescoping legs 18 are hollow and have a rectangular or square cross-sectional configuration. Opposite ends of each rung 20 extend completely through the respective inner telescoping legs 18 so as to present reinforced openings 22 at the externally facing surface of each rung 20. Accordingly, a plurality of reinforced openings 22 thereby extend in spaced relation along each externally facing surface of each inner telescoping leg 18, corresponding to the positions of rungs 20.

An opening 24 is provided at the upper end of the connecting leg section **13*c* of each outer telescoping leg 12, and is adapted to align with any of the openings 22** of the respective inner telescoping leg 18, depending upon the position of the inner telescoping leg 18 within outer telescoping leg 12.

Each inner telescoping leg 18 can be fixed at a telescopically slidable position within its respective outer telescoping leg 12 by a height adjustment assembly 25 secured to the external surface of each outer telescoping leg 12. Specifically, height adjustment assembly 25 includes an assembly cap 26 secured to or formed on the external surface of connecting leg section 13*c* of each outer telescoping leg 12, in surrounding relation to opening 24 therein. Cap 26 is formed as a truncated pyramid with a large base which is open and secured to the external surface of connecting leg section 13*c* and a small base which is closed. Specifically, cap 26 is formed with four side walls 26*a*–26*d* and a top wall 26*e* connected to side walls 26*a*–26*d*. Accordingly, an enclosure 27 is formed between cap 26 and the external surface of connecting leg section 13*c* of the respective outer telescoping leg 12, such enclosure 27 being accessible through opening 24.

Top wall 26*e* of assembly cap 26 has a central aperture 28*a* formed therein in alignment with opening 24 in connecting leg section 13*c* of outer telescoping leg 12. Two holes 28*b* and 28*c* are arranged on opposite sides of central aperture 28*a* along a diagonal of top wall 26*e* and two depressions 28*d* and 28*e* are arranged on opposite sides of central aperture 28*a* along the other diagonal of top wall 26*e*.

Height adjustment assembly 25 further includes an adjustment cap 30 having a flat inner surface 30*a* and a central depression 32 therein. A transverse hole 34 extends through a side surface of adjustment cap 30 into communication with depression 32. In addition, two posts 36 extend from flat inner surface 30*a* on opposite sides of depression 32, posts 36 being dimensioned to slidably fit within holes 28*b* and 28*c* and to sit within depressions 28*d* and 28*e*. In such case, when posts 36 extend into holes 28*b* and 28*c* or into depressions 28*d* and 28*e*, central depression 32 is in alignment with central aperture 28*a* in top wall 26*e* of assembly cap 26.

Height adjustment assembly 25 further includes a locking pin 38 having a shaft 38*a* and an enlarged head 38*b*. The free end of shaft 38*a* has a transverse hole 38*c* extending entirely therethrough. Enlarged head 38*b* has dimensions to permit it to fit within a reinforced opening 22, as shown in FIG. 5. In addition, shaft 38*a* has dimensions to permit it to fit within central depression 32. In such case, a pin 40 is inserted through transverse hole 34 of adjustment cap 30 and into transverse hole 38*c* to secure locking pin 38 to adjustment cap 30, as shown in FIG. 5.

In addition, a coil spring 41 is positioned about shaft 38*a*, between enlarged head 38*b* and the inner surface of top wall 26*e*, within enclosure 27. As a result, coil spring 41 biases adjustment cap 30 inwardly such that enlarged head 38*b* fits within a reinforced opening 22 to lock the inner telescoping legs 18 with respect to the outer telescoping legs 18, when posts 36 are inserted through holes 28*b* and 28*c*.

In order to change the height of combination folding ladder and height adjustable scaffold 10, adjustment cap 30 is pulled outwardly and turned so that posts 36 enter depressions 28*d* and 28*e*. Since posts 36 no longer extend completely through top wall 26*e*, end adjustment cap 30 is moved to the left of the position shown in FIG. 5 and maintained thereat, against the force of coil spring 41. Accordingly, locking pin 38 is also moved to the left of the position shown in FIG. 5, whereby enlarged head 38*b* thereof is no longer positioned in any reinforced opening 22. Thus, inner telescoping leg 18 is free to telescopically move within outer telescoping leg 12. To lock inner telescoping leg 18 at a new position in outer telescoping leg 12, adjustment cap 30 is once again pulled out and turned so that posts 36 enter holes 28*b* and 28*c*, such that height adjustment assembly 25 is moved to the locking position shown in FIG. 5.

Of course, inner telescoping legs 18 can be locked at different positions with respect to outer telescoping legs 12 by any other suitable means, such as those described in U.S. Pat. Nos. 3,692,143 to Kummerlin et al; 3,794,141 to Sturm; 4,210,224 to Kummerlin et al; 4,371,055 to Ashton; and 4,376,470 to Ashton, the entire disclosures of which are incorporated herein by reference.

Figure 2:
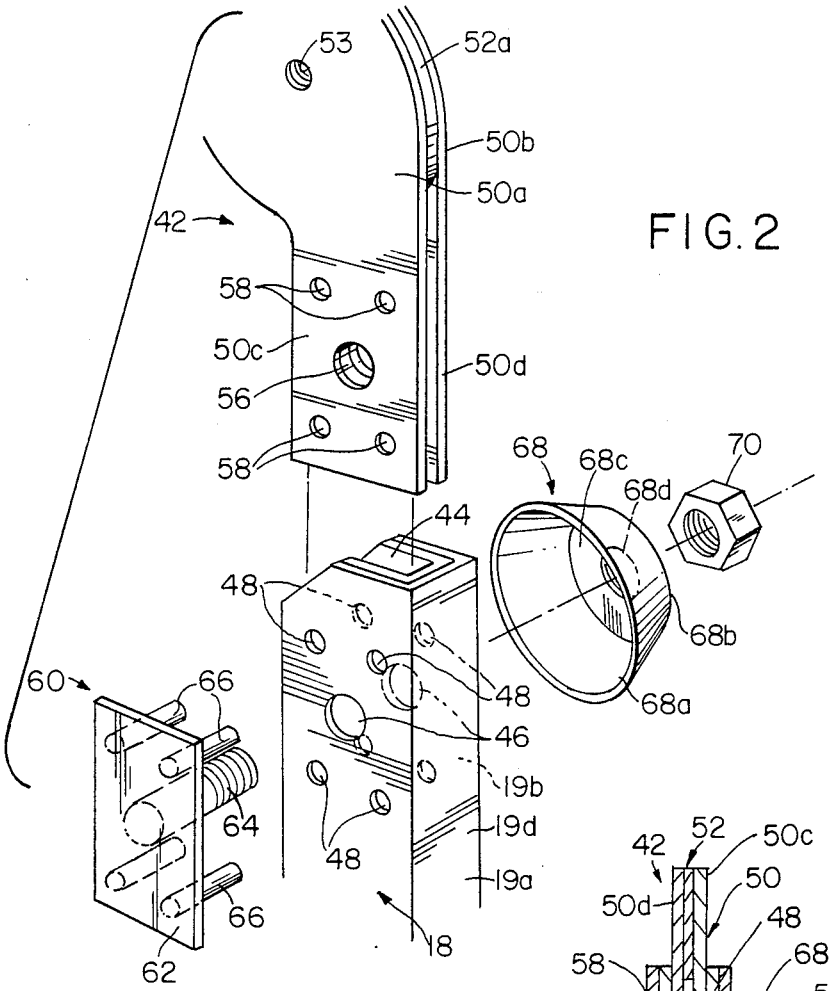
FIG. 2 is an exploded perspective view of one removable hinge section of the combination folding ladder and height adjustable scaffold of FIG. 1.
Figure 3:
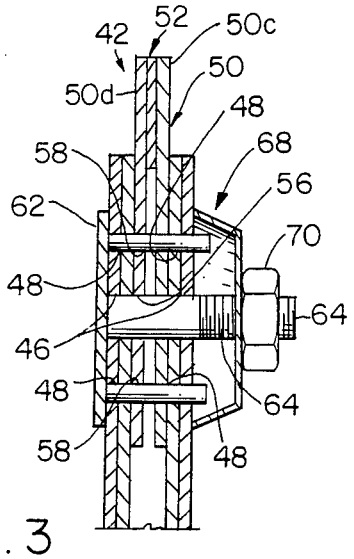
FIG. 3 is a cross-sectional view of the hinge section of FIG. 2 in assembled condition.

Referring now to FIGS. 1, 2 and 3, it will be seen that the upper ends of inner telescoping legs 18*a* and 18*c* are pivotally connected together by a positioning joint 42, and the upper ends of inner telescoping legs 18*b* and 18*d* are also pivotally connected together by a positioning joint 42.

Specifically, the upper ends of inner telescoping legs 18 are hollow with side leg sections 19*a* and 19*b*, and end leg sections 19*c* and 19*d*, so as to define a channel 44 therein. Bolt holes 46 are formed in side leg sections 19*a* and 19*b*, respectively, with bolt holes 46 in sections 19*a* and 19*b* being in alignment with each other. In addition, four alignment holes 48 are formed in side leg section 19*a* in surrounding relation to the bolt hole 46 therein, and in like manner, four alignment holes 48 are formed in side leg section 19*b* in surrounding relation to the bolt hole 46 therein, with the alignment holes 48 in side leg sections 19*a* and 19*b* being in alignment with each other.

Each positioning joint 42 includes an outer joint member 50 and an inner joint member 52 rotatably connected together and which can be locked in a plurality of preset angular positions with respect to each other. Each outer joint member 50 includes two disc shaped portions 50*a* and 50*b* which terminate in two leg portions 50*c* and 50*d*, respectively. Each inner joint member 52 includes a disc shaped portion 52*a* rotatably interposed between disc shaped portions 50*a* and 50*b* about a common axle 53, and a locking means 54 is also provided for releasably locking disc shaped portion 52*a* at any of a plurality of angular positions with respect to disc shaped portions 50*a* and 50*b*, as is conventional. Each disc shaped portion 52*a* terminates in a leg portion (not shown) which is disposed at an angle to leg portions 50*c* and 50*d*.

As shown in FIG. 2, leg portions 50*c* and 50*d* are each formed with a central hole 56 and four alignment holes 58 in surrounding relation thereto. When leg portions 50*c* and 50*d* are inserted into channel 44 of, for example, inner telescoping leg 18*a* or 18*d*, as shown in FIG. 1, holes 56 and 58 align with bolt holes 46 and alignment holes 48, respectively. In like manner, the leg portion of each inner joint member 52 includes similar holes 56 (not shown) and 58 (not shown) which are in alignment with bolt holes 46 and alignment holes 48, when such leg portion is inserted in channel 44 of, for example, inner telescoping leg 18*b* or 18*d*.

The leg portions of outer joint member 50 and inner joint member 52 are each releasably connected with a respective inner telescoping leg 18 by a retaining assembly 60. Retaining assembly 60 includes a plate 62 having a bolt 64 extending centrally therefrom and four alignment pins 66 also extending therefrom in surrounding relation to bolt 64. In this manner, when an outer joint member 50 or an inner joint member 52 fits within a channel 44, bolt 64 extends through bolt holes 46 and central holes 56. At such time, alignment pins 66 extend through alignment holes 48 and 58 to prevent rotation of outer joint member 50 or inner joint member 52 therein. Thus, plate 62 is positioned flush against the outer surface of side leg section 19*a*.

Retaining assembly 60 further includes a frusto-conical cap washer 68 having a larger base 68*a* which is open and a smaller base 68*b* which is closed by a closure plate 68*c* having a central hole 68*d* therein. Larger base 68*a* is adapted to sit against the outer surface of side leg section 19*b* in surrounding relation to alignment pins 66 that extend therethrough, as shown best in FIG. 3. In this position, bolt 64 extends through central hole 68*d*, and is secured at its free end by a retaining nut 70.

Thus, the leg portions of each positioning joint 42 are releasably secured to respective inner telescoping legs 18.

Positioning joints 42 may be constructed in accordance with U.S. patent application No. 206,195, filed Jun. 13, 1988; or any of U.S. Pat. No. 3,811,151 to Kuemmerlin; 4,152,810 to Martinez; 4,216,844 to Klafs; 4,377,020 to Vigo; 4,403,373 to Kummerlin; 4,407,045 to Boothe; 4,543,007 to Quiogue; 4,566,150 to Boothe; 4,645,371 to Wang; and 4,666,328 to Ryu, the entire disclosures of which are incorporated herein by reference. Accordingly, for the sake of brevity, a more detailed description of each positioning joint 42 is not presented herein.

Figure 6:
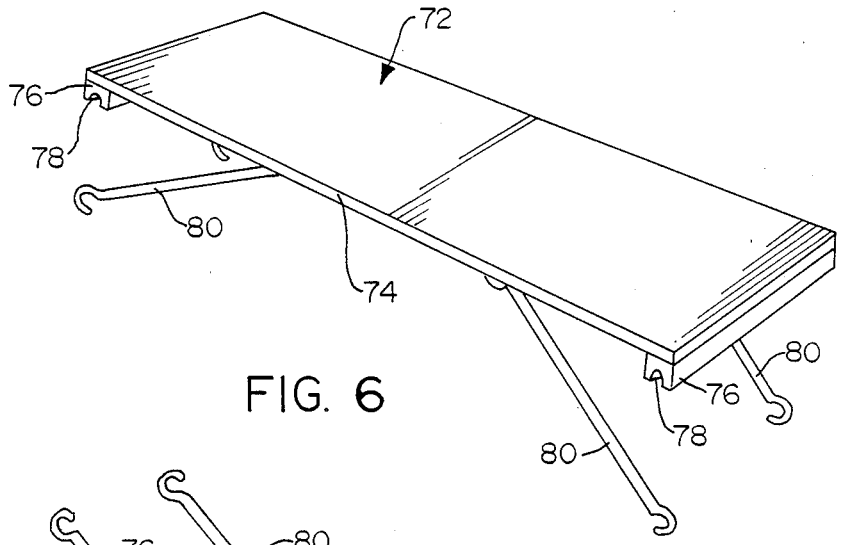
FIG. 6 is a top perspective view of a platform that can be used with the combination folding ladder and height adjustable scaffold of FIG. 1 when the latter is in a scaffold configuration.
Figure 7:
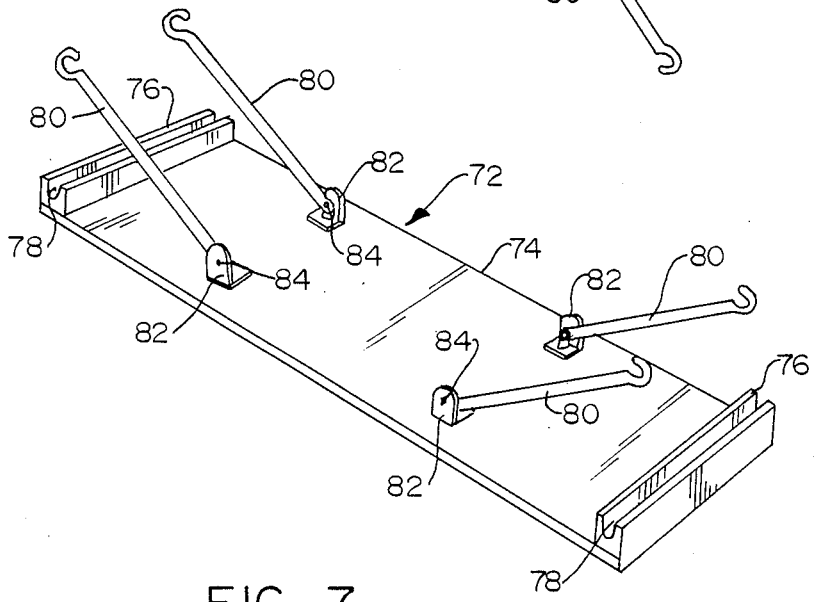
FIG. 7 is a bottom perspective view of the platform of FIG. 6.

In accordance with the present invention, combination folding ladder and height adjustable scaffold 10 can be used as either a ladder or a scaffold. In this regard, when used as a scaffold, a scaffold platform 72 is provided, as shown in FIGS. 6 and 7. Scaffold platform 72 is formed by a flat rectangular plate or board 74 having U-shaped supports 76 extending across the short ends thereof at the underside of board 74. In this regard, each U-shaped support 76 presents a downwardly extending open channel 78 for receiving an outer rung 16 or an inner rung 20 so as to support scaffold platform 72 on combination folding ladder and height adjustable scaffold 10 when the ladder is in its scaffold position, as will be explained in greater detail hereinafter.

Further, a plurality of hook arms 80 are pivotally secured to the underside of flat board 74. In this regard, four L-shaped pivot supports 82 are secured to the underside of flat board 74, and each hook arm 80 is pivotally secured to a pivot support 82 by a pivot pin 84. The opposite end of each hook arm 80 terminates in a hook end 86 which is adapted to engage an outer rung 16 or an inner rung 20.

Thus, in order to use combination folding ladder and height adjustable scaffold 10 in its scaffold configuration, retaining nuts 70 are unscrewed from bolts 64, and retaining assembly 60 is detached from inner telescoping legs 18. Thereafter, positioning joints 42 are removed from inner telescoping legs 18. In such case, the first assembly 88 of outer telescoping legs 18*a*, 18*b* and inner telescoping legs 12*a*, 12*b* can be separated from the second assembly 90 of outer telescoping legs 18*c*, 18*d* and inner telescoping legs 12*c*, 12*d*. Thereafter, the height of inner telescoping legs 18 with respect to outer telescoping legs 12 can be adjusted with height adjustment assemblies 25.

Figure 8:
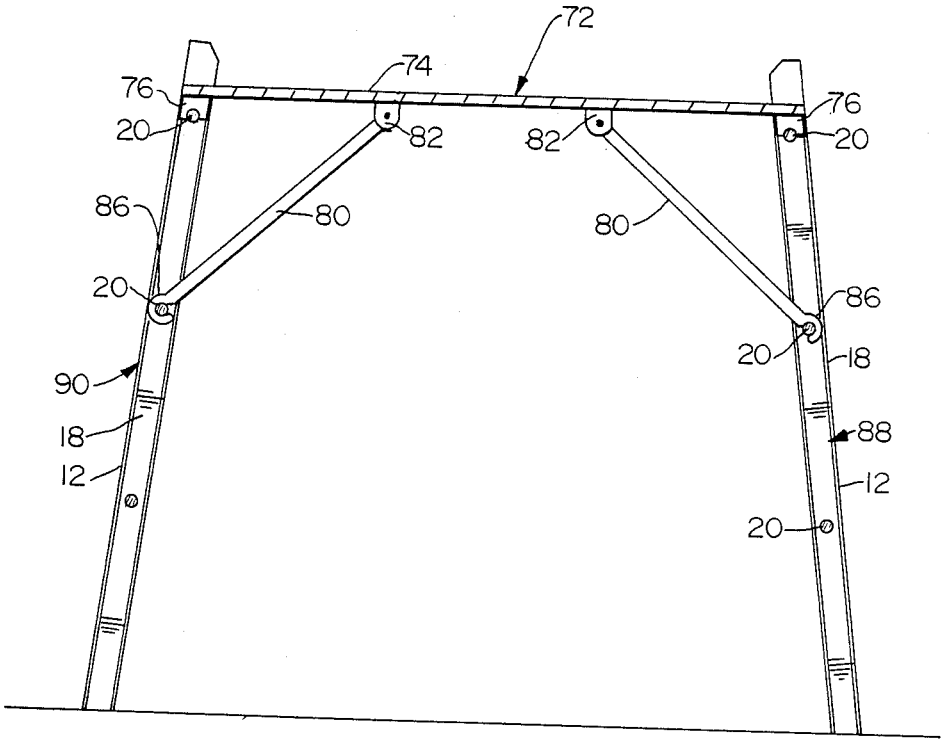
FIG. 8 is a cross-sectional view of the combination folding ladder and height adjustable scaffold according to the present invention in a scaffold configuration and used with the platform of FIG. 6 mounted to the inner rungs on the inner telescoping legs of the ladder.

As an example, FIG. 8 shows the situation where assemblies 88 and 90 are separated from each other and inner telescoping legs 18 are fully positioned within outer telescoping legs 12, so that assemblies 88 and 90 are adjusted for a low height. Outer rungs 16 are omitted from FIG. 8 for ease of explanation. In such case, open channels 78 of U-shaped supports 76 receive the uppermost inner rungs 20 on assemblies 88 and 90, and hook ends 86 are pivoted over the next lower set of inner rungs 20, as shown, to provide a fixed scaffold structure. Because of the two rung attachment on each assembly 88 and 90, assemblies 88 and 90 are fixed to provide a stable support.

Figure 9:
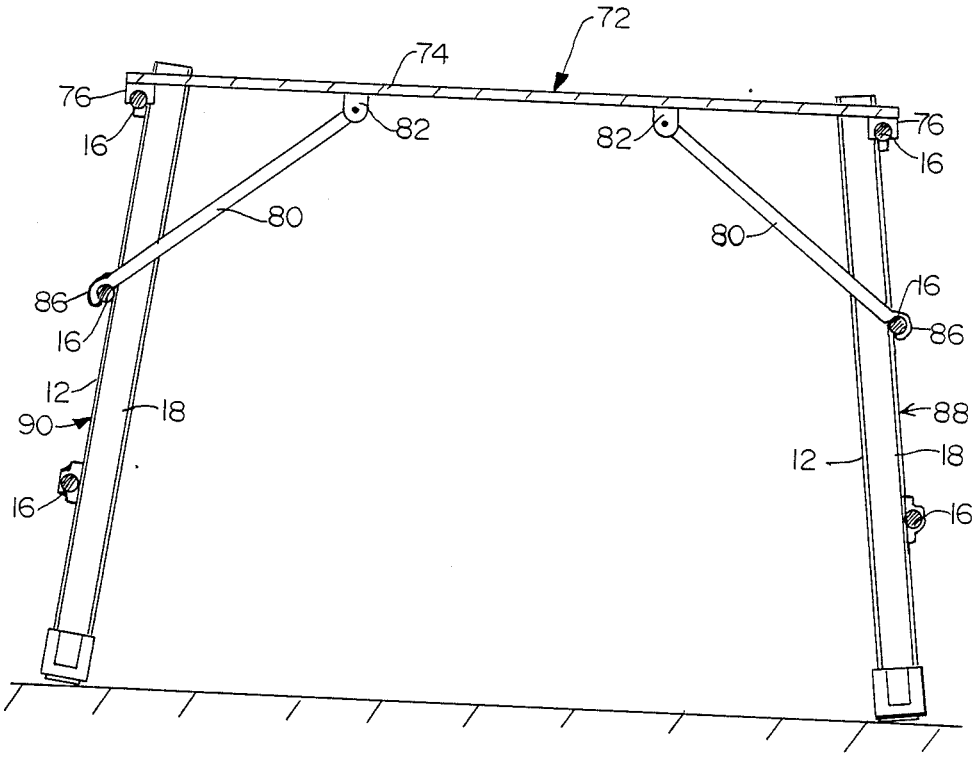
FIG. 9 is a cross-sectional view of the combination folding ladder and height adjustable scaffold according to the present invention in a scaffold configuration and used with the platform of FIG. 6 mounted to the outer rungs on the outer telescoping legs of the ladder.

Referring now to FIG. 9, another arrangement of combination folding ladder and height adjustable scaffold 10 in its scaffold configuration is shown, which is identical to that of FIG. 8, with the exception that open channels 78 of U-shaped supports 76, and hook ends 86, receive outer rungs 16 therein. Inner rungs 20 are omitted from FIG. 9 for ease of explanation.

Figure 10:
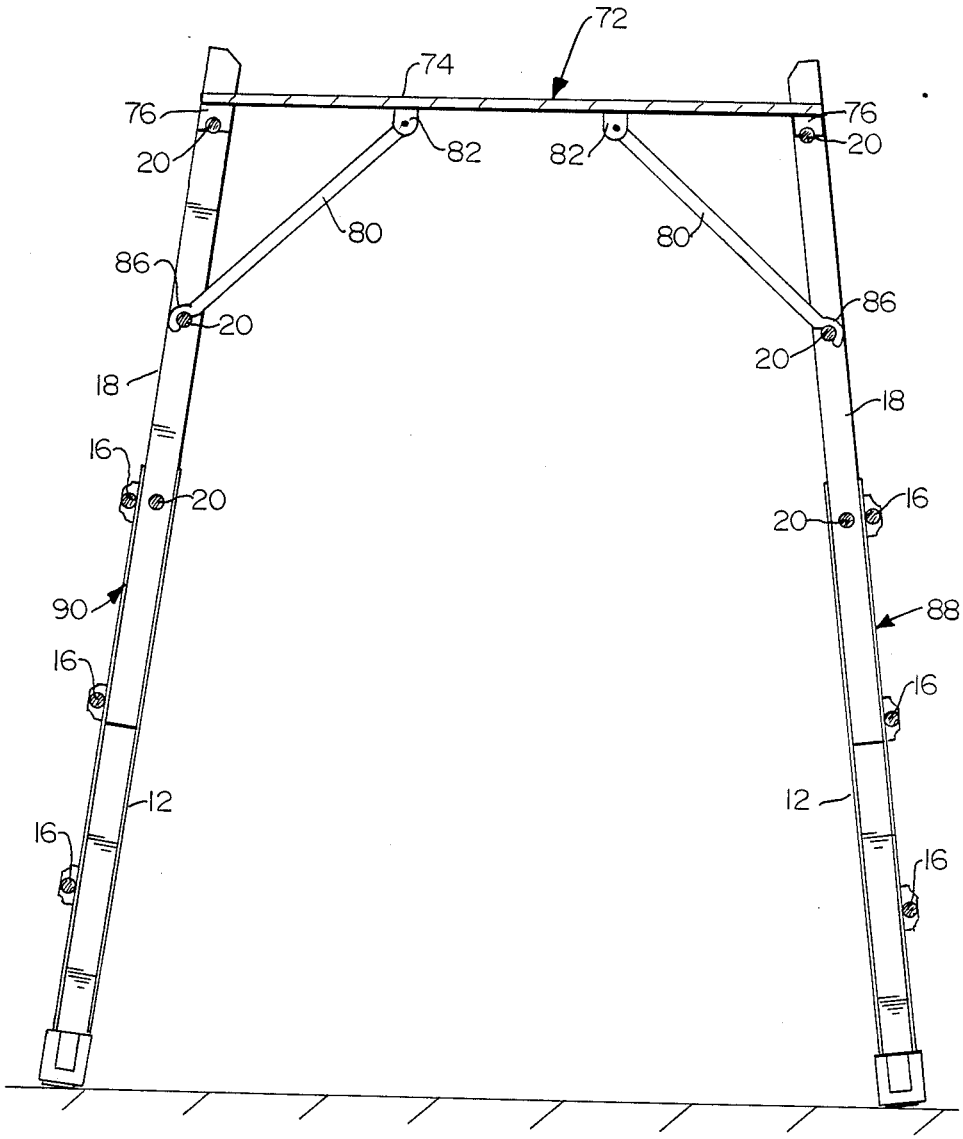
FIG. 10 is a cross-sectional view of the combination folding ladder and height adjustable scaffold according to the present invention in a scaffold configuration and used with the platform of FIG. 6 mounted to the inner rungs on the inner telescoping legs of the ladder when the inner telescoping legs of the ladder are extended upwardly from the outer telescoping legs of the ladder.
Figure 11:
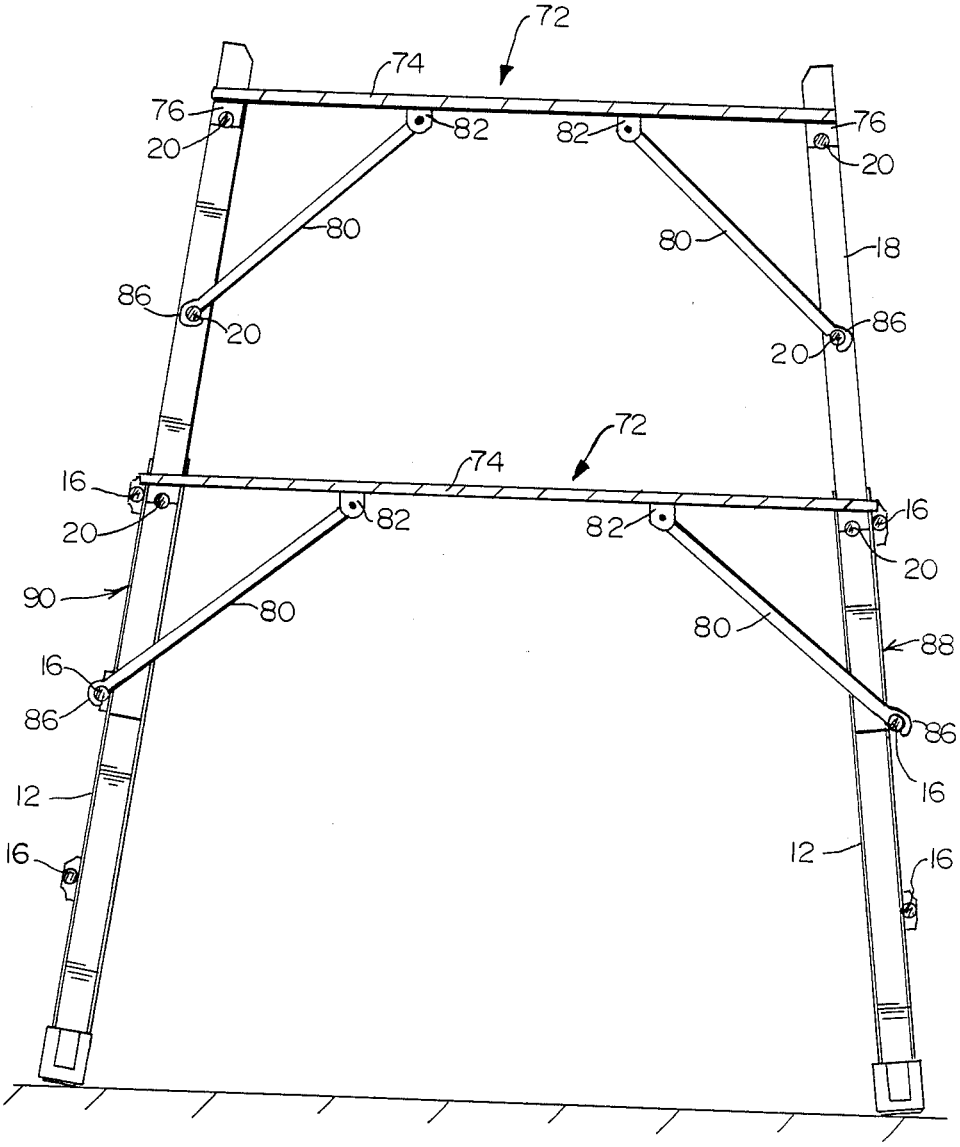
FIG. 11 is a cross-sectional view of the combination folding ladder and height adjustable scaffold according to the present invention in a scaffold configuration and used with two platforms of FIG. 6 mounted to the inner rungs on the inner telescoping legs of the ladder and to the outer rungs of the outer telescoping legs, respectively, when the inner telescoping legs of the ladder are extended upwardly from the outer telescoping legs of the ladder.

An arrangement in which assemblies 88 and 90 are extended to a maximum height and in which open channels 78 of U-shaped supports 76, and hook ends 86, receive inner rungs 20 therein at an uppermost position, is shown in FIG. 10. A similar arrangement in which a second scaffold 72 is supported on both outer rungs 16 and inner rungs 20 is shown in FIG. 11. Specifically, open channels 78 of U-shaped supports 76 receive a lower set of inner rungs 20, while hook ends 86 receive a still lower set of outer rungs 16.

Figure 12:
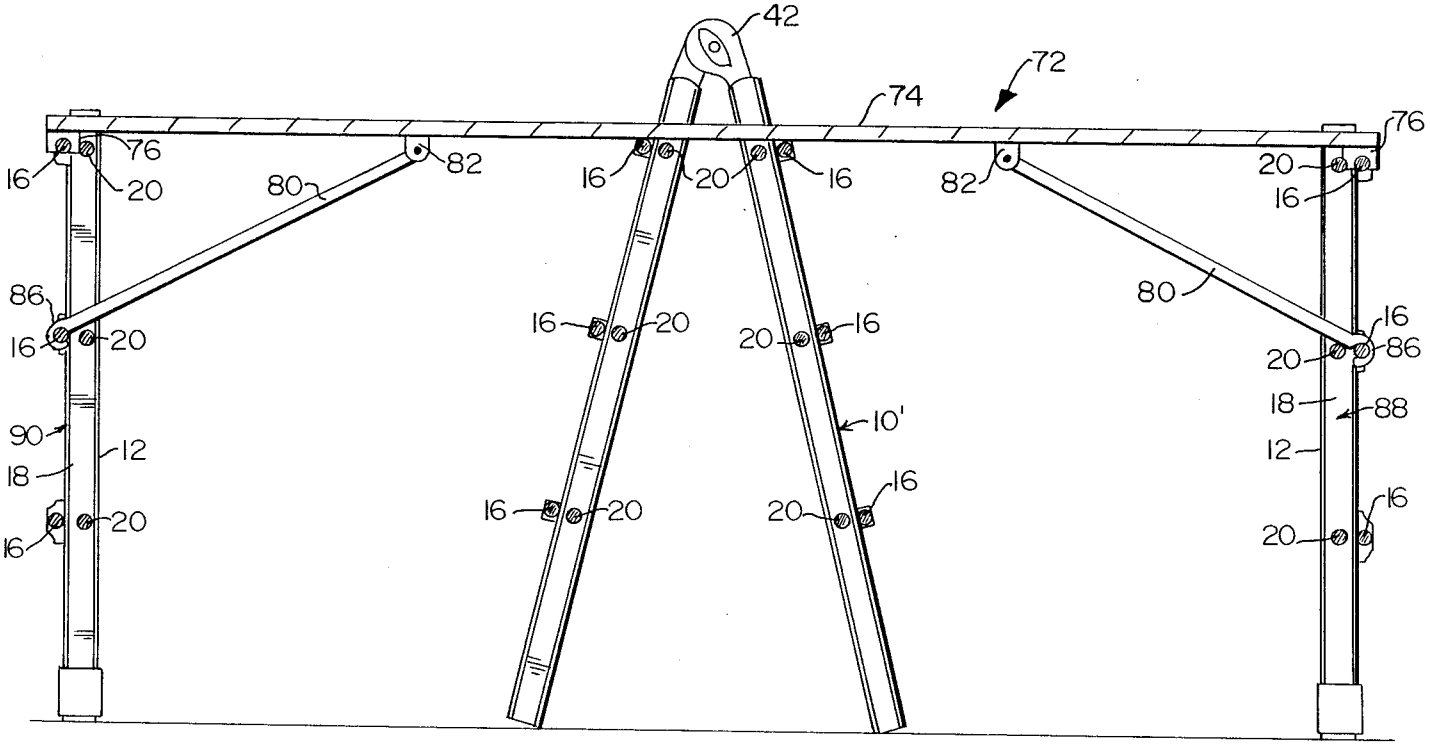
FIG. 12 is a side elevational view of the combination folding ladder and height adjustable scaffold according to the present invention in a scaffold configuration and used with the platform of FIG. 6 in a different manner.

When using a very long platform 72, there may be a tendency for the platform 72 to bend at the center due to the weight thereon. Accordingly, as shown in FIG. 12, an arrangement substantially identical to that shown in FIG. 9 is used, and additionally, a combination folding ladder and height adjustable scaffold 10' in its ladder configuration is used therewith. Specifically, the uppermost outer rungs 16 and the uppermost inner rungs 20 of combination folding ladder and height adjustable scaffold 10' are used to support the center of platform 72.

Of course, it will be appreciated that, while the present invention has been described with an extensible ladder, it could be used with a non-extensible ladder. Further, while rungs have been described on both assemblies 88 and 90, it is possible to use rungs on only one assembly, and to use some other means on the other assembly to connect the legs together and to support platform 72. For example, in conventional non-extensible ladders, X-shaped supports connect the legs of second assembly 90 together. In such case, short posts could extend from each leg of second assembly 90 for supporting platform 72.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A combination folding ladder and height adjustable scaffold, comprising:

(a) a first assembly including:

(i) a first leg, (ii) a second leg, and (iii) a plurality of rungs connecting together said first and second legs in substantially parallel, spaced apart relation, each rung adapted to support one end of a scaffold platform;

(b) a second assembly including:

(i) a third leg, (ii) a fourth leg, (iii) means for connecting together said third and fourth legs in substantially parallel, spaced apart relation and for providing a scaffold support which supports an opposite end of the scaffold platform;

(c) joint means removably secured to upper ends of said first through fourth legs for pivotally securing said first and second assemblies together, said joint means including:

(i) an outer joint section formed by a central rotatable section and a leg section depending therefrom, (ii) an inner joint section formed by a central rotatable section and a leg section depending therefrom, (iii) means for rotatably securing together said central rotatable sections of said outer and inner joint sections; and (d) securing means for removably securing said leg sections of said joint means to upper ends of said first through fourth legs.

2. A combination folding ladder and height adjustable scaffold according to claim 1; wherein each of said first through fourth legs includes an outer telescoping member and an inner telescoping member which telescopically slides within said outer telescoping member.

3. A combination folding ladder and height adjustable scaffold according to claim 1; wherein said first assembly includes a plurality of inner rungs connecting together said inner telescoping members of said first and second legs and a plurality of outer rungs connecting together said outer telescoping members of said first and second legs in said substantially parallel, spaced apart relation; and said means for connecting of said second assembly includes a plurality of inner rungs connecting together said inner telescoping members of said third and fourth legs and a plurality of outer rungs connecting together said outer telescoping members of said third and fourth legs in said substantially parallel, spaced apart relation.

4. A combination folding ladder and height adjustable scaffold according to claim 2; further including height adjustment means for releasably locking said inner telescoping members of said first through fourth legs at any of a plurality of selected heights with respect to said outer telescoping members of said first through fourth legs.

5. A combination folding ladder and height adjustable scaffold, comprising:

(a) a first assembly including:

(i) a first leg, (ii) a second leg, and (iii) a plurality of rungs connecting together said first and second legs in substantially parallel, spaced apart relation, each rung adapted to support one end of a scaffold platform;

(b) a second assembly including:

(i) a third leg, (ii) a fourth leg, (iii) means for connecting together said third and fourth legs in substantially parallel, spaced apart relation and for providing a scaffold support which supports an opposite end of the scaffold platform;

(c) upper ends of said first through fourth legs each include at least one through hole extending therethrough;

(d) joint means removably secured to upper ends of said first through fourth legs for pivotally securing said first and second assemblies together, said joint means including:

(i) an outer joint section formed by a central rotatable section and a lege section depending therefrom, said leg section including at least one bolt hole extending therethrough;

(ii) an inner joint section formed by a central rotatable section and a leg section depending therefrom, said leg section including at least one bolt hole extending therethrough; and (iii) means for rotatably securing together said central rotatable sections of said outer and inner joint sections; and (d) securing means for removably securing said joint means to upper ends of said first through fourth legs, said securing means including bolt means extending through said at least one bolt hole of said leg sections of said outer and inner joint sections and said at least one through hole in said upper end of each respective leg, and nut means threadedly engageable with said bolt means for removably securing said joint means to upper ends of said first through fourth legs.

6. A combination folding ladder and height adjustable scaffold according to claim 5; wherein (a) said leg section of said inner joint section includes a bolt hole for receiving said bolt means, and a plurality of alignment holes;

(b) said leg section of said outer joint section includes a bolt hole for receiving said bolt means, and a plurality of alignment holes; and (c) said securing means includes a plurality of alignment pins extending through said alignment holes of said leg sections of said inner and outer joint sections when said bolt means extends through said bolt holes of said leg sections of said outer and inner joint sections and said at least one through hole in said upper end of each respective leg.

7. A combination folding ladder and height adjustable scaffold according to claim 6; wherein said securing means further includes plate means for holding said bolt means thereon and for holding said alignment pins thereon in surrounding relation to said bolt means; and cap washer means having a hole for receiving said bolt means and interposed between each said upper end of said legs and said nut means.

8. A combination folding ladder and height adjustable scaffold, comprising:

(a) a first assembly including:

(i) a first leg, (ii) a second leg, and (iii) a plurality of rungs connecting together said first and second legs in substantially parallel, spaced apart relation;

(b) a second assembly including:

(i) a third leg, (ii) a fourth leg, (iii) means for connecting together said third and fourth legs in substantially parallel, spaced apart relation and for providing a scaffold support;

(c) joint means removably secured to upper ends of said first through fourth legs for pivotally securing said first and second assemblies together, said joint means including:
(i) an outer joint section formed by a central rotatable section and a leg section depending therefrom,
(ii) an inner joint section formed by a central rotatable section and a leg section depending therefrom,
(iii) means for rotatably securing together said central rotatable sections of said outer and inner joint sections;
(d) securing means for removably securing said leg sections of said joint means to upper ends of said first through fourth legs; and
(e) a scaffold platform for use with said combination folding ladder and height adjustable scaffold when said joint means is removed from said upper ends of said first through fourth legs and said first and second assemblies are separated, said scaffold platform including:
(i) first means at one end of said platform for supporting said one end on at least one said rung of said first assembly, and
(ii) second means at the opposite end of said platform for supporting said opposite end on said means for connecting of said second assembly, so as to provide a stable scaffold with said first assembly, said second assembly separated therefrom and said scaffold platform connecting together said first and second assemblies.

9. A combination folding ladder and height adjustable scaffold according to claim 8; wherein said scaffold platform includes a substantially flat board; channel means at opposite ends of said flat board for receiving said rungs of said first assembly and said means for connecting of said second assembly at a first vertical level; and hook means on said board for receiving said rungs of said first assembly and said means for connecting of said second assembly at a second vertical level.

10. A combination folding ladder and height adjustable scaffold according to claim 9; wherein said scaffold platform includes U-shaped support means at opposite ends of said flat board for defining said channel means.

11. A combination folding ladder and height adjustable scaffold according to claim 10; wherein said hook means includes a plurality of hook arms pivotally secured to said board, each hook arm having a hook end for receiving and engaging said rungs of said first assembly and said means for connecting of said second assembly at said second vertical level.

12. A combination folding ladder and height adjustable scaffold according to claim 11; wherein said board has a substantially rectangular configuration with short ends and long ends, said U-shaped support means are provided on the underside of said board across said short ends therof, and there are four hook arms pivotally secured to the underside of said board at positions between said short ends thereof.

13. A combination folding ladder and height adjustable scaffold according to claim 8; wherein each of said first through fourth legs includes an outer telescoping member and an inner telescoping member which telescopically slides within said outer telescoping member.

14. A combination folding ladder and height adjustable scaffold according to claim 13; wherein said first assembly includes a plurality of inner rungs connecting together said inner telescoping members of said first and second legs and a plurality of outer rungs connecting together said outer telescoping members of said first and second legs in said substantially parallel, spaced apart relation; and said means for connecting of second assembly includes a plurality of inner rungs connecting together said inner telescoping members of said third and fourth legs and a plurality of outer rungs connecting together said outer telescoping members of said third and fourth legs in said substantially parallel, spaced apart relation.

15. A combination folding ladder and height adjustable scaffold according to claim 14; wherein said scaffold platform includes a substantially flat board; channel means at opposite ends of said flat board for receiving any of said rungs of said first and second assemblies at a first vertical level; and hook means on said board for receiving any of said rungs of said first and second assemblies at a second vertical level.

16. A combination folding ladder and height adjustable scaffold according to claim 15; wherein said scaffold platform includes U-shaped support means at opposite ends of said flat board for defining said channel means.

17. A combination folding ladder and height adjustable scaffold according to claim 16; wherein said hook means includes a plurality of hook arms pivotally secured to said board, each hook arm having a hook end for receiving and engaging any of said rungs of said first and second assemblies at said second vertical level.

18. A combination folding ladder and height adjustable scaffold according to claim 17; wherein said board has a substantially rectangular configuration with short ends and long ends, said U-shaped support means are provided on the underside of said board across said short ends thereof, and there are four hook arms pivotally secured to the underside of said board at positions between said short ends thereof.

19. A combination folding ladder and height adjustable scaffold according to claim 13; further including height adjustment means for releasably locking said inner telescoping members of said first through fourth legs at any of a plurality of selected heights with respect to said outer telescoping members of said first through fourth members.

20. A combination folding ladder and height adjustable scaffold, comprising:
(a) a first assembly including:
(i) a first leg,
(ii) a second leg, and
(iii) a plurality of rungs connecting together said first and second legs in substantially parallel, spaced apart relation;
(b) a second assembly including:
(i) a third leg,
(ii) a fourth leg,
(iii) means for connecting together said third and fourth legs in substantially parallel, spaced apart relation and for providing a scaffold support;
(c) upper ends of said first through fourth legs each include at least one through hole extending therethrough;
(d) joint means removably secured to upper ends of said first through fourth legs for pivotally securing said first and second assemblies together, said joint means including:
(i) an outer joint section formed by a central rotatable section and a leg section depending therefrom, said leg section including at least one bolt hole extending therethrough;

(ii) an inner joint section formed by a central rotatable section and a leg section depending therefrom, said leg section including at least one bolt hole extending therethrough; and (iii) means for rotatably securing together said central rotatable sections of said outer and inner joint sections;

(e) securing means for removably securing said joint means to upper ends of said first through fourth legs, said securing means including bolt means extending through said at least one bolt hole of said leg sections of said outer and inner joint sections and said at least one through hole in said upper end of each respective leg, and nut means threadedly engageable with said bolt means for removably securing said joint means to upper ends of said first through fourth legs; and (f) a scaffold platform for use with said combination folding ladder and height adjustable scaffold when said joint means is removed from said upper ends of said first through fourth legs and said first and second assemblies are separated, said scaffold platform including:

(i) first means at one end of said platform for supporting said one end on at least one said rung of said first assembly, and (ii) second means at the opposite end of said platform for supporting said opposite end on said means for connecting of said second assembly, so as to provide a stable scaffold with said first assembly, said second assembly separated therefrom and said scaffold platform connecting together said first and second assemblies.

21. A combination folding ladder and height adjustable scaffold according to claim 20; wherein (a) said leg section of said inner joint section includes a bolt hole for receiving said bolt means, and a plurality of alignment holes;

(b) said leg section of said outer joint section includes a bolt hole for receiving said bolt means, and a plurality of alignment holes; and (c) said securing means includes a plurality of alignment pins extending through said alignment holes of said leg sections of said inner and outer joint sections when said bolt means extends through said bolt holes of said leg sections of said outer and inner joint sections and said at least one through hole in said upper end of each respective leg.

22. A combination folding ladder and height adjustable scaffold according to claim 21; wherein said securing means further includes plate means for holding said bolt means thereon and for holding said alignment pins thereon in surrounding relation to said bolt means; and cap washer means having a hole for receiving said bolt means and interposed between each said upper end of said legs and said nut means.

23. A combination folding ladder and height adjustable scaffold, comprising:

(a) a first assembly including:

(i) a first leg including an outer telescoping member and an inner telescoping member which telescopically slides therein, (ii) a second leg including an outer telescoping member and an inner telescoping member which telescopically slides therein, and (iii) a plurality of inner rungs connecting together said inner telescoping members of said first and second legs in substantially parallel, spaced apart relation;

(iv) a plurality of outer rungs connecting together said outer telescoping members of said first and second legs in substantially parallel, spaced apart relation;

(b) a second assembly including:

(i) a third leg including an outer telescoping member and an inner telescoping member which telescopically slides therein, (ii) a fourth leg including an outer telescoping member and an inner telescoping member which telescopically slides therein, (iii) a plurality of inner rungs connecting together said inner telescoping members of said third and fourth legs in substantially parallel, spaced apart relation;

(iv) a plurality of outer rungs connecting together said outer telescoping members of said third and fourth legs in substantially parallel, spaced apart relation;

(c) joint means removably secured to upper ends of said first through fourth legs for pivotally securing said first and second assemblies together, said joint means including:

(i) an outer joint section formed by a central rotatable section and a leg section depending therefrom, (ii) an inner joint section formed by a central rotatable section and a leg section depending therefrom, (iii) means for rotatably securing together said central rotatable sections of said outer and inner joint sections;

(d) securing means for removably securing said leg sections of said joint means to upper ends of said first through fourth legs;

(e) height adjustment means for releasably locking said inner telescoping members of said first through fourth legs at any of a plurality of selected heights with respect to said outer telescoping members of said first through fourth legs; and (f) a scaffold platform for use with said combination folding ladder and height adjustable scaffold when said joint means is removed from said upper ends of said first through fourth legs and said first and second assemblies are separated, said scaffold platform including:

(i) a substantially flat rectangular board having short ends and long ends, (ii) U-shaped support means at said opposite short ends of said flat board on the underside thereof for defining channel means for receiving any of said rungs of said first and second assemblies at a first vertical level so as to support opposite ends of said board, and (iii) a plurality of hook arms pivotally secured to the underside of said board for receiving any of said rungs of said first and second assemblies at a second vertical level so as to support opposite ends of said board, each hook arm having a hook end for receiving and engaging any of said rungs of said first and second assemblies, wherein a stable scaffold is provided by said first assembly, said second assembly separated therefrom and said scaffold platform connecting together said first and second assemblies.

* * * * *